US008951393B2

(12) United States Patent
Yao et al.

(10) Patent No.: US 8,951,393 B2
(45) Date of Patent: Feb. 10, 2015

(54) FLUORINE GAS GENERATING APPARATUS

(75) Inventors: Akifumi Yao, Ube (JP); Nobuyuki Tokunaga, Ube (JP)

(73) Assignee: Central Glass Company, Limited, Yamaguchi (JP)

( * ) Notice: Subject to any disclaimer, the term of this patent is extended or adjusted under 35 U.S.C. 154(b) by 299 days.

(21) Appl. No.: 13/574,295

(22) PCT Filed: Jan. 18, 2011

(86) PCT No.: PCT/JP2011/050714

§ 371 (c)(1),
(2), (4) Date: Jul. 20, 2012

(87) PCT Pub. No.: WO2011/090014

PCT Pub. Date: Jul. 28, 2011

(65) Prior Publication Data

US 2012/0292180 A1 Nov. 22, 2012

(30) Foreign Application Priority Data

Jan. 21, 2010 (JP) ..... 2010-011010

(51) Int. Cl.
*C25B 1/24* (2006.01)
*C25B 15/02* (2006.01)
(Continued)

(52) U.S. Cl.
CPC . *C25B 1/245* (2013.01); *C25B 9/00* (2013.01); *C25B 15/02* (2013.01); *C25B 15/08* (2013.01)
USPC ..... 204/247; 204/246; 205/411

(58) Field of Classification Search
CPC ..... C25B 1/245; C25B 9/08; C25B 15/00; C25B 15/02; C25B 15/08
USPC ..... 204/246, 247; 205/411
See application file for complete search history.

(56) References Cited

U.S. PATENT DOCUMENTS 5,088,290 A * 2/1992 Yasue ..... 62/51.1
5,290,413 A * 3/1994 Bauer et al. ..... 204/243.1
(Continued)

FOREIGN PATENT DOCUMENTS

JP 61-220421 A 9/1986
JP 10-319000 A 12/1998
(Continued)

OTHER PUBLICATIONS

Froning et al. Purification and compression of Fluorine. Industrail and Engineering Chemistry. vol. 39, No. 3. pp. 275-278. 1947.*
(Continued)

*Primary Examiner* — Harry D Wilkins, III
*Assistant Examiner* — Ciel Thomas
(74) *Attorney, Agent, or Firm* — Westerman, Hattori, Daniels & Adrian, LLP

(57) ABSTRACT

A provided emergency stop facility includes an alternative gas supply facility capable of supplying a cooling medium in a refining device as an alternative gas instead of an entrained gas shut-off by closure of an entrained gas shut-off valve with loss of a driving source caused by the emergency stop; an alternative entrained gas shut-off valve switching between supply and shut-off of an alternative gas to a hydrogen fluoride supply passage; and an instrumentation gas supply facility for emergency stop having an instrumentation gas shut-off valve enabling supply of an instrumentation gas by opening with loss of the driving source caused by the emergency stop, wherein at the emergency stop of the fluorine gas generating apparatus, the alternative entrained gas shut-off valve is opened upon receipt of the supply of the instrumentation gas, and the alternative gas is supplied to the hydrogen fluoride supply passage.

5 Claims, 2 Drawing Sheets

(51) Int. Cl.
*C25B 15/08* (2006.01)
*C25B 9/00* (2006.01)

(56) References Cited

U.S. PATENT DOCUMENTS

| | | | | |
|---|---|---|---|---|
| 5,792,429 | A * | 8/1998 | Easterly et al. | 422/117 |
| 2007/0215460 | A1 * | 9/2007 | Tojo et al. | 204/245 |

FOREIGN PATENT DOCUMENTS

| | | | |
|---|---|---|---|
| JP | 11-087329 | A | 3/1999 |
| JP | 2004-043885 | A | 2/2004 |
| JP | 2009-191362 | A | 8/2009 |

OTHER PUBLICATIONS

International Search Report of PCT/JP2011/050714, mailing date of Apr. 26, 2011.

* cited by examiner

FLUORINE GAS GENERATING APPARATUS

BACKGROUND OF THE INVENTION

The present invention relates to a fluorine gas generating apparatus.

As a prior-art fluorine gas generating apparatus, an apparatus which generates fluorine gas by electrolysis using an electrolytic cell is known.

JP2004-43885A discloses a fluorine gas generating apparatus provided with an electrolytic cell 32 for electrolyzing hydrogen fluoride in molten salt containing hydrogen fluoride, generating a product gas mainly containing a fluorine gas in a first gas phase section on an anode side, and generating a byproduct gas mainly containing a hydrogen gas in a second gas phase section on a cathode side.

In the electrolytic cell 32, a raw material pipe 82 for supplying hydrogen fluoride, which is a raw material, into the molten salt is disposed. A hydrogen fluoride source 84 and a nitrogen source 94 are connected to the raw material pipe 82 through pipes 83 and 93. A switch valve 86 is disposed in the pipe 83 on the hydrogen fluoride source 84 side, while a switch valve 96 is disposed in the pipe 93 on the nitrogen source 94 side.

SUMMARY OF THE INVENTION

In the fluorine gas generating apparatus as described in JP2004-43885A, if the entire apparatus is emergently stopped due to trouble such as outage or the like, the switch valves 86 and 96 are automatically closed so that the supply of hydrogen fluoride and a nitrogen gas is shut off. At this time, hydrogen fluoride vapor remaining in the raw material pipe 82 dissolves into the molten salt in the electrolytic cell 32, and the pressure in the raw material pipe 82 lowers, which might incur a backflow of the molten salt in the electrolytic cell 32 to the raw material pipe 82. In that case, the back flow of the molten salt is coagulated and blocks the raw material pipe 82.

As described above, in the case of the emergency stop of the entire apparatus due to trouble such as outage or the like, the apparatus cannot be stopped safely. Moreover, at re-start, the blocked raw material pipe needs a recovery work, and the apparatus cannot be restarted quickly.

The present invention was made in view of the above problems and has an object to provide a fluorine gas generating apparatus that can be safely stopped in the case of emergency stop and can be restarted quickly.

An aspect of the present invention is a fluorine gas generating apparatus which generates a fluorine gas by electrolyzing hydrogen fluoride in molten salt, including: an electrolytic cell divided above a liquid level of the molten salt into a first gas chamber into which a product gas mainly containing a fluorine gas generated at an anode immersed in the molten salt is led and a second gas chamber into which a byproduct gas mainly containing a hydrogen gas generated at a cathode immersed in the molten salt is led; a refining device which refines the fluorine gas by coagulating with a cooling medium and trapping a hydrogen fluoride gas evaporated from the molten salt in the electrolytic cell and mixed in the product gas generated from the anode; a hydrogen fluoride supply passage for replenishing hydrogen fluoride of a hydrogen fluoride supply source in the electrolytic cell; an entrained gas supply source which supplies an entrained gas for leading the hydrogen fluoride of the hydrogen fluoride supply source to the electrolytic cell to the hydrogen fluoride supply passage; an entrained gas shut-off valve which switches between supply and shut-off of the entrained gas of the entrained gas supply source; and an emergency stop facility operating at emergency stop of the fluorine gas generating apparatus, wherein the emergency stop facility includes: an alternative gas supply facility capable of supplying the cooling medium used for coagulation of the hydrogen fluoride gas in the refining device as an alternative gas instead of the entrained gas shut-off by closure of the entrained gas shut-off valve with loss of a driving source caused by the emergency stop of the fluorine gas generating apparatus; an alternative gas shut-off valve which switches between supply and shut-off of the alternative gas of the alternative gas supply facility to the hydrogen fluoride supply passage; and an instrumentation gas supply facility for emergency stop having an instrumentation gas shut-off valve which enables supply of an instrumentation gas by opening the instrumentation gas shut-off valve with loss of the driving source caused by the emergency stop of the fluorine gas generating apparatus, wherein at the emergency stop of the fluorine gas generating apparatus, the alternative gas shut-off valve is opened upon receipt of the supply of the instrumentation gas of the instrumentation gas supply facility for emergency stop, and the alternative gas of the alternative gas supply facility is supplied to the hydrogen fluoride supply passage.

According to an aspect of the present invention, instrumentation gas shut-off valve is opened with loss of an operating source at an emergency stop, an alternative gas shut-off valve is opened upon receipt of supply of the instrumentation gas and an alternative gas of an alternative gas supply facility is supplied to a hydrogen fluoride supply passage. Thus, backflow of the molten salt into the hydrogen fluoride supply passage can be prevented. Therefore, the fluorine gas generating apparatus can be safely stopped at emergency of the fluorine gas generating apparatus, and the fluorine gas generating apparatus can be restarted quickly.

DESCRIPTION OF THE EMBODIMENTS

An embodiment of the present invention will be described below by referring to the attached drawings.

Figure 1:
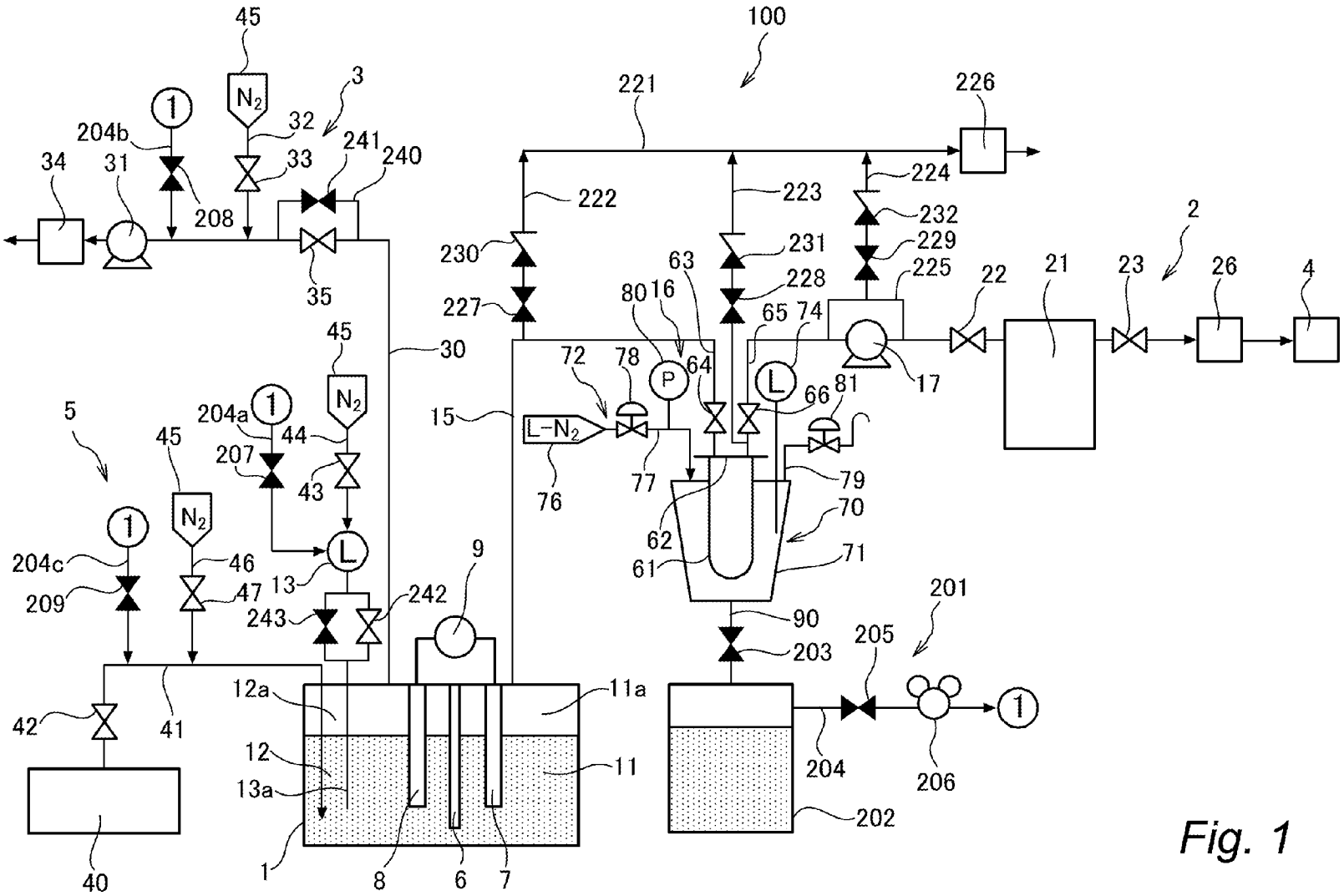
FIG. 1 is a system diagram illustrating a fluorine gas generating apparatus according to an embodiment of the present invention.

A fluorine gas generating apparatus 100 according to the embodiment of the present invention will be described by referring to FIG. 1.

The fluorine gas generating apparatus 100 generates a fluorine gas by electrolysis and supplies the generated fluorine gas to an external device 4. The external device 4 is a semiconductor manufacturing device, for example, and in that case, the fluorine gas is used as a cleaning gas in a manufacturing process of a semiconductor, for example.

The fluorine gas generating apparatus 100 includes electrolytic cell 1 which generates a fluorine gas by electrolysis, a fluorine gas supply system 2 which supplies the fluorine gas generated from the electrolytic cell 1 to the external device 4, and a byproduct gas treatment system 3 which treats a byproduct gas generated with the generation of the fluorine gas.

First, the electrolytic cell 1 will be described.

The electrolytic cell 1 retains molten salt containing hydrogen fluoride (HF). In this embodiment, a mixture (KF.2HF) of hydrogen fluoride and potassium fluoride (KF) is used as the molten salt.

The inside of the electrolytic cell 1 is divided by a partition wall 6 immersed in the molten salt to an anode chamber 11 and a cathode chamber 12. An anode 7 and a cathode 8 are immersed in the molten salt in the anode chamber 11 and the cathode chamber 12, respectively. By means of supply of an electric current between the anode 7 and the cathode 8 from a power supply 9, a product gas mainly containing a fluorine gas ($F_2$) is generated at the anode 7, while a byproduct gas mainly containing a hydrogen gas ($H_2$) is generated at the cathode 8. A carbon electrode is used for the anode 7, while soft iron, monel or nickel is used for the cathode 8.

Above the liquid level of the molten salt in the electrolytic cell 1, a first gas chamber 11*a* into which the fluorine gas generated at the anode 7 is introduced and a second gas chamber 12*a* into which the hydrogen gas generated at the cathode 8 is led are partitioned by a partition wall 6 from each other so that the gases cannot go out of or come into each other. As described above, the first gas chamber 11*a* and the second gas chamber 12*a* are completely separated by the partition wall 6 in order to prevent reaction by contact between the fluorine gas and the hydrogen gas. On the other hand, the molten salt in the anode chamber 11 and the cathode chamber 12 is not separated by the partition wall 6 but communicates with each other below the partition wall 6.

The melting point of KF.2HF is 71.7° C., and thus, the temperature of the molten salt is adjusted to 90 to 100° C. Hydrogen fluoride is evaporated from the molten salt by an amount of a vapor pressure and mixed in each of the fluorine gas and the hydrogen gas generated from the anode 7 and the cathode 8 of the electrolytic cell 1. As described above, a hydrogen fluoride gas is contained in each of the fluorine gas generated at the anode 7 and introduced into the first gas chamber 11*a* and the hydrogen gas generated at the cathode 8 and introduced into the second gas chamber 12*a*.

In the electrolytic cell 1, a liquid level meter 13 which detects a liquid level of the retained molten salt as a liquid level detector is provided. The nitrogen gas is supplied as a purge gas to the liquid level meter 13 from a nitrogen gas supply source 45 through a purge gas supply passage 44. The nitrogen gas supplied to the liquid level meter 13 is purged into the molten salt by a given flow rate through an insertion pipe 13*a* inserted into the electrolytic cell 1. The liquid level meter 13 is a back-pressure type liquid level meter which detects a back pressure when the nitrogen gas is purged into the molten salt and detects a liquid level from the back pressure and liquid specific gravity of the molten salt. A shut-off valve 43 which switches between supply and shut-off of the nitrogen gas is provided in the purge gas supply passage 44.

The shut-off valve 43 is a pneumatic valve driven by compressed air supplied from a compressor (not shown) and a normal-close valve closed when there is no supply of the compressed air.

Subsequently, the fluorine gas supply system 2 will be described.

A first main passage 15 for supplying the fluorine gas to the external device 4 is connected to the first gas chamber 11*a*.

A first pump 17 which leads the fluorine gas out of the first gas chamber 11*a* and conveys it is provided in the first main passage 15. A positive-displacement pump such as a bellows pump, a diaphragm pump or the like is used for the first pump 17.

A refining device 16 for trapping the hydrogen fluoride gas mixed in the product gas and refining the fluorine gas is provided upstream of the first pump 17 in the first main passage 15. The refining device 16 is a device for separating and removing the hydrogen fluoride gas from the fluorine gas by using a difference in boiling points between fluorine and hydrogen fluoride.

The refining device 16 includes an inner tube 61 as a gas inflow unit into which the fluorine gas containing the hydrogen fluoride gas flows and a cooling device 70 which cools the inner tube 61 at a temperature not lower than the boiling point of fluorine and not higher than the melting point of hydrogen fluoride so that the fluorine gas passes through the inner tube 61, while the hydrogen fluoride gas mixed in the fluorine gas is coagulated.

The inner tube 61 is a bottomed cylindrical member, and an upper opening thereof is sealed by a lid member 62. An inlet passage 63 which leads the fluorine gas generated in the anode 7 into the inner tube 61 and an outlet passage 65 for discharging the fluorine gas from the inner tube 61 are connected to the lid member 62. The inlet passage 63 and the outlet passage 65 constitute a part of the first main passage 15.

An inlet valve 64 which allows or shuts off inflow of the fluorine gas into the inner tube 61 is provided in the inlet passage 63. An outlet valve 66 which allows or shuts off outflow of the fluorine gas from the inner tube 61 is provided in the outlet passage 65.

The cooling device 70 includes a jacket tube 71 capable of partially containing the inner tube 61 and capable of retaining liquid nitrogen as a cooling medium therein and a liquid nitrogen supply/discharge system 72 which supplies/discharges liquid nitrogen to/from the jacket tube 71.

A liquid nitrogen supply passage 77 which leads liquid nitrogen supplied from a liquid nitrogen supply source 76 into the jacket tube 71 is connected to the jacket tube 71. In the liquid nitrogen supply passage 77, a flow rate control valve 78 which controls a supply flow rate of the liquid nitrogen is provided. On the downstream of the flow rate control valve 78 in the liquid nitrogen supply passage 77, a pressure meter 80 which detects an internal pressure of the jacket tube 71 is provided.

The inside of the jacket tube 71 is formed of two layers, that is, the liquid nitrogen and an evaporated nitrogen gas, and the liquid level of the liquid nitrogen is detected by a liquid level meter 74.

A nitrogen gas discharge passage 79 for discharging the nitrogen gas in the jacket tube 71 is connected to the jacket tube 71. A pressure regulating valve 81 which controls the internal pressure of the jacket tube 71 is provided in the nitrogen gas discharge passage 79. The pressure regulating valve 81 controls on the basis of a detection result of the pressure meter 8 such that the internal pressure of the jacket tube 71 becomes a predetermined pressure determined in advance. This predetermined pressure is determined so that the temperature of the liquid nitrogen in the jacket tube 71 becomes not lower than the boiling point (−188° C.) of fluorine and not higher than the melting point (−84° C.) of hydrogen fluoride. Specifically, the pressure is set to 0.4 MPa so that the temperature of the liquid nitrogen in the jacket tube 71 becomes approximately −180° C. As described above, the pressure regulating valve 81 controls the internal pressure of the jacket tube 71 to 0.4 MPa so that the temperature of the liquid nitrogen in the jacket tube 71 is maintained at approximately −180° C. The nitrogen gas discharged through the pressure regulating valve 81 is emitted to the atmosphere.

When the liquid nitrogen in the jacket tube 71 is evaporated and discharged, the liquid nitrogen in the jacket tube 71 decreases. Thus, the flow rate control valve 78 controls the supply flow rate of the liquid nitrogen from the liquid nitrogen supply source 76 to the jacket tube 71 on the basis of a detection result of the liquid level meter 74 so that the liquid level of the liquid nitrogen in the jacket tube 71 is maintained constant.

Since the inner tube 61 is cooled by the jacket tube 71 to a temperature not lower than the boiling point of fluorine and not higher than the melting point of hydrogen fluoride, only hydrogen fluoride mixed in the fluorine gas is coagulated in the inner tube 61, and the fluorine gas passes through the inner tube 61. In this way, the hydrogen fluoride gas mixed in the product gas is trapped, and the fluorine gas is refined.

A first buffer tank 21 which retains the fluorine gas conveyed by the first pump 17 is provided on the downstream of the first pump 17 in the first main passage 15. The fluorine gas retained in the first buffer tank 21 is supplied to the external device 4.

A flow meter 26 which detects a flow rate of the fluorine gas supplied to the external device 4 is provided downstream of the first buffer tank 21. A power supply 9 controls a current value supplied between the anode 7 and the cathode 8 on the basis of a detection result of the flow meter 26. Specifically, a generation amount of the fluorine gas at the anode 7 is controlled so that the fluorine gas amount supplied to the external device 4 from the first buffer tank 21 is replenished.

As described above, the generation amount of the fluorine gas at the anode 7 is controlled so that the fluorine gas amount supplied to the external device 4 is replenished, and an internal pressure of the first buffer tank 21 is maintained at a pressure higher than the atmospheric pressure. On the other hand, since the external device 4 side where the fluorine gas is used is at the atmospheric pressure, by opening a valve provided in the external device 4, the fluorine gas is supplied from the first buffer tank 21 to the external device 4 due to a pressure difference between the first buffer tank 21 and the external device 4.

Shut-off valves 22 and 23 which allow or shut off distribution of the fluorine gas are provided upstream and downstream of the first buffer tank 21 in the first main passage 15, respectively.

The inlet valve 64, the outlet valve 66, the shut-off valve 22, and the shut-off valve 23 provided in the first main passage 15 are pneumatic valves driven by the compressed air supplied from the compressor and normal-close type valves closed when there is no supply of compressed air.

Subsequently, the byproduct gas treatment system 3 will be described.

A second main passage 30 for discharging the hydrogen gas to the outside is connected to the second gas chamber 12*a*.

A second pump 31 which leads the hydrogen gas out of the second gas chamber 12*a* and conveys it is provided in the second main passage 16.

To the upstream of the second pump 31 in the second main passage 30, a nitrogen gas as a diluent gas for preventing explosion which lowers concentration of the hydrogen gas is supplied from the nitrogen gas supply source 45 through the diluent gas supply passage 32. In the diluent gas supply passage 32, a shut-off valve 33 which switches between supply and shut-off of the nitrogen gas is provided.

Moreover, on the upstream of the second pump 31 in the second main passage 30, a shut-off valve 35 which switches between distribution and shut-off of the hydrogen gas is provided.

An abatement unit 34 is provided on the downstream of the second pump 31 in the second main passage 30, and the hydrogen gas conveyed by the second pump 31 is rendered harmless in the abatement unit 34 and emitted.

The shut-off valve 33 provided in the diluent gas supply passage 32 and the shut-off valve 35 provided in the second main passage 30 are pneumatic valves driven by the compressed air supplied from the compressor and normal-close type valves closed when there is no supply of the compressed air.

The fluorine gas generating apparatus 100 is also provided with a raw material supply system 5 for supplying hydrogen fluoride which is a raw material of the fluorine gas into the molten salt in the electrolytic cell 1. The raw material supply system 5 will be described below.

The raw material supply system 5 includes a hydrogen fluoride supply source 40 in which hydrogen fluoride to be replenished to the electrolytic cell 1 is retained. The hydrogen fluoride supply source 40 and the electrolytic cell 1 are connected through the hydrogen fluoride supply passage 41. The hydrogen fluoride retained in the hydrogen fluoride supply source 40 is supplied into the molten salt in the electrolytic cell 1 through the hydrogen fluoride supply passage 41. In the hydrogen fluoride supply passage 41, a shut-off valve 42 which switches between supply and shut-off of hydrogen fluoride from the hydrogen fluoride supply source 40 to the electrolytic cell 1 is provided.

To the hydrogen fluoride supply passage 41, a nitrogen gas as an entrained gas is supplied from the nitrogen gas supply source 45 as an entrained gas supply source through an entrained gas supply passage 46. In the entrained gas supply passage 46, a shut-off valve 47 as an entrained gas shut-off valve which switches between supply and shut-off of the entrained gas is provided. The entrained gas is a gas for leading the hydrogen fluoride retained in the hydrogen fluoride supply source 40 into the molten salt in the electrolytic cell 1. The nitrogen gas which is an entrained gas is hardly dissolved in the molten salt and is discharged from the second gas chamber 12*a* through the byproduct gas treatment system 3.

The shut-off valve 42 provided in the hydrogen fluoride supply passage 41 and the shut-off valve 47 provided in the entrained gas supply passage 46 are pneumatic valves driven by the compressed air supplied from the compressor and normal-close type valves closed when there is no supply of the compressed air.

As described above, the shut-off valve 43 which is a normal-close type pneumatic valve is provided in the liquid level meter 13 of the electrolytic cell 1.

Moreover, in the fluorine gas supply system 2, the inlet valve 64, the outlet valve 66, the shut-off valve 22, and the shut-off valve 23 which are normal-close type pneumatic valves are provided.

Moreover, in the byproduct gas treatment system 3, the shut-off valve 33 and the shut-off valve 35 which are normal-close type pneumatic valves are provided.

Moreover, in the raw material supply system 5, the shut-off valve 42 and the shut-off valve 47 which are normal-close type pneumatic valves are provided.

At the emergency stop of the fluorine gas generating apparatus 100 with outage, a failure of the compressor or the like, these pneumatic valves are closed by loss of the compressed air which is a driving source.

In that case, since supply of the nitrogen gas which is a purge gas is shut off in the liquid level meter 13, the hydrogen fluoride vapor in the electrolytic cell 1 flows into the liquid level meter 13, and the liquid level meter 13 might corrode by hydrogen fluoride and fail.

Moreover, in the fluorine gas supply system 2, since the inner tube 61 and the first pump 17 of the refining device 16 are sealed, respectively, the internal pressures of the inner tube 61 and the first pump are raised, and the fluorine gas might leak.

Moreover, in the byproduct gas treatment system 3, since the supply of the nitrogen gas which is a diluent gas is shut off, the concentration of the hydrogen gas in the second main passage 30 might be raised.

Moreover, in the raw material supply system 5, the supply of the hydrogen fluoride from the hydrogen fluoride supply source 40 to the electrolytic cell 1 and the supply of the nitrogen gas which is an entrained gas are shut off. As a result, the hydrogen fluoride vapor remaining in the hydrogen fluoride supply passage 41 is dissolved in the molten salt in the electrolytic cell 1, and the pressure in the hydrogen fluoride supply passage 41 lowers, and thus, the molten salt in the electrolytic cell 1 might flow back to the hydrogen fluoride supply passage 41. In that case, consolidation of the backflow molten salt might block the hydrogen fluoride supply passage 41.

Furthermore, in the electrolytic cell 1, since the inside is brought into the sealed state, the internal pressure might be raised and the molten salt might leak.

As a measure against them, the fluorine gas generating apparatus 100 is provided with an emergency stop facility which operates in emergency stop and stops the entire apparatus safely. The emergency stop facility will be described below.

The emergency stop facility includes an alternative gas supply facility 201 capable of supplying an alternative gas instead of the nitrogen gas of the nitrogen gas supply source 45 which is shut off by closing each pneumatic valve with loss of the driving sources caused by the emergency stop of the fluorine gas generating apparatus 100 and an instrumentation gas supply facility 210 for emergency stop (See FIG. 2) capable of supplying an instrumentation gas to the alternative gas supply facility 201 with loss of the driving sources caused by the emergency stop of the fluorine gas generating apparatus 100.

The alternative gas supply facility 201 is provided with a nitrogen buffer tank 202 which recovers and stores the liquid nitrogen which was used for coagulation of the hydrogen fluoride gas in the cooling device 70 of the refining device 16 and discharged and can supply the nitrogen gas as an alternative gas.

To the jacket tube 71 of the cooling device 70, a liquid nitrogen discharge passage 90 for discharging the liquid nitrogen is connected. The downstream end of the liquid nitrogen discharge passage 90 is connected to the nitrogen buffer tank 202. In the liquid nitrogen discharge passage 90, a cooling medium shut-off valve 203 for switching between discharge and shut-off of the liquid nitrogen in the jacket tube 71 to the nitrogen buffer tank 202 is provided. The cooling medium shut-off valve 203 is a pneumatic valve driven by the instrumentation gas supplied from the instrumentation gas supply facility 210 for emergency stop and a normal-close type valve closed in a usual state in which the instrumentation gas is not supplied.

Since the nitrogen buffer tank 202 is arranged below the jacket tube 71, when the cooling medium shut-off valve 203 is opened, the liquid nitrogen in the jacket tube 71 is discharged to the nitrogen buffer tank 202 by the gravity.

The inside of the nitrogen buffer tank 202 receiving the discharge of the liquid nitrogen is formed of two layers, that is, the liquid nitrogen and the nitrogen gas. To the nitrogen buffer tank 202, an alternative gas supply passage 204 for supplying the internal nitrogen gas to each spot of the fluorine gas generating apparatus 100 as an alternative gas is connected. In the alternative gas supply passage 204, an alternative gas shut-off source valve 205 which switches between supply and shut-off of the alternative gas is provided. Moreover, on the downstream of the alternative gas shut-off source valve 205, a pressure reducing valve 206 which reduces the pressure of the alternative gas to a predetermined pressure is provided.

The alternative gas supply passage 204 is branched into multiple passages on the way, and the nitrogen gas in the nitrogen buffer tank 202 is supplied to each spot in the fluorine gas generating apparatus 100 as an alternative gas of the nitrogen gas of the nitrogen gas supply source 45. Specifically, the alternative gas supply passage 204 is branched into an alternative purge gas supply passage **204*a* which supplies the purge gas to the liquid level meter 13, an alternative diluent gas supply passage 204*b* which supplies the diluent gas to the second main passage 30, and an alternative entrained gas supply passage 204*c* which supplies the entrained gas to the hydrogen fluoride supply passage 41**.

In the alternative purge gas supply passage **204*a*, an alternative purge gas shut-off valve 207 which switches between supply and shut-off of the purge gas is provided. In the alternative diluent gas supply passage 204*b*, an alternative diluent gas shut-off valve 208 which switches between supply and shut-off of the diluent gas is provided. In the alternative entrained gas supply passage 204*c*, an alternative entrained gas shut-off valve 209** which switches between supply and shut-off of the entrained gas is provided.

The alternative gas shut-off source valve 205, the alternative purge gas shut-off valve 207, the alternative diluent gas shut-off valve 208, and the alternative entrained gas shut-off valve 209 are pneumatic valves driven by the instrumentation gas supplied from the instrumentation gas supply facility 210 for emergency stop and normal-close type valves closed in a usual state in which the instrumentation gas is not supplied.

Moreover, the insertion pipe **13*a* of the liquid level meter 13 is branched in parallel on the way, and in one of the passages, a usual-time supply valve 242 which is in an open state during the usual operation and enables supply of the purge gas is provided, while in the other passage, an emergency supply valve 243 which changes to an open state at the emergency stop of the fluorine gas generating apparatus 100** and enables supply of the purge gas is provided.

The usual-time supply valve 242 is a pneumatic valve driven by the compressed air supplied from the compressor (not shown) and normal-close type valve closed when there is no supply of the compressed air. Moreover, the emergency supply valve 243 is a pneumatic valve driven by the instrumentation gas supplied from the instrumentation gas supply facility 210 for emergency stop and normal-close type valve closed in the usual state when there is no supply of the instrumentation air.

Figure 2:
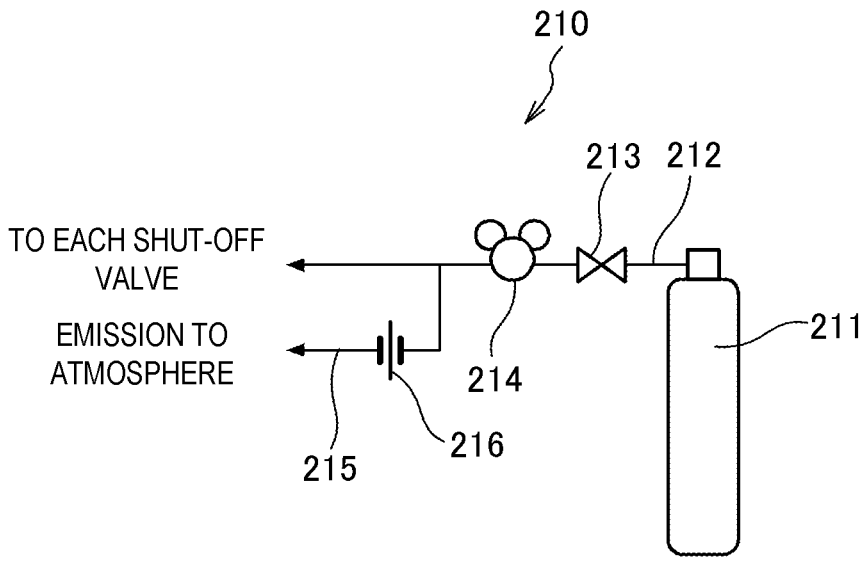
FIG. 2 is a system diagram of an instrumentation gas supply facility for emergency stop.

As illustrated in FIG. 2, the instrumentation gas supply facility 210 for emergency stop is provided with a gas cylinder 211 as an instrumentation gas container filled with the compressed air which is the instrumentation gas. To the gas cylinder 211, an instrumentation gas supply passage 212 for supplying the internal instrumentation gas to the cooling medium shut-off valve 203, the alternative gas shut-off source valve 205, the alternative purge gas shut-off valve 207, the alternative diluent gas shut-off valve 208, the alternative entrained gas shut-off valve 209, and the emergency supply valve 243 is connected. In the instrumentation gas supply passage 212, an instrumentation gas shut-off valve 213 which switches between supply and shut-off of the instrumentation gas is provided. Moreover, on the downstream of the instrumentation gas shut-off valve 213, a pressure reducing valve 214 which reduces the pressure of the instrumentation gas to a predetermined pressure is provided. The instrumentation gas shut-off valve 213 is a pneumatic valve driven by the compressed air supplied from the compressor and normal-open type valve opened when there is no supply of the compressed air. Therefore, in the usual state in which the compressor is operating, the instrumentation gas shut-off valve 213 is in the closed state.

The instrumentation gas shut-off valve 213 is opened by loss of the compressed air which is the driving source at emergency stop of the fluorine gas generating apparatus 100 caused by outage, a failure of the compressor or the like. As a result, the instrumentation gas in the gas cylinder 211 is supplied to the cooling medium shut-off valve 203, the alternative gas shut-off source valve 205, the alternative purge gas shut-off valve 207, the alternative diluent gas shut-off valve 208, the alternative entrained gas shut-off valve 209, and the emergency supply valve 243 through the instrumentation gas supply passage 212, and each of the valves 203, 205, 207, 208, 209, and 243 which received the supply of the instrumentation gas which is the driving source is opened. As described above, at emergency stop of the fluorine gas generating apparatus 100, each of the valves 203, 205, 207, 208, 209, and 243 is opened.

On the downstream of the pressure reducing valve 214 in the instrumentation gas supply passage 212, an emission passage 215 which emits the instrumentation gas into the atmosphere is branched. In the emission passage 215, an orifice 216 as a flow rate limitation unit which limits an emission flow rate of the instrumentation gas is provided. As described above, after the instrumentation gas shut-off valve 213 is opened, the instrumentation gas in the instrumentation gas supply passage 212 is emitted to the atmosphere through the emission passage 215. If the pressure of the instrumentation gas falls below a required driving pressure of each of the valves 203, 205, 207, 208, 209, and 243 with the emission of the instrumentation gas in the instrumentation gas supply passage 212 to the atmosphere, each of the valves 203, 205, 207, 208, 209, and 243 is closed. The total amount of the instrumentation gas is determined by the capacity of the gas cylinder 211, and the emission flow rate of the instrumentation gas is determined by a diameter of the orifice 216. Therefore, valve-opening time of each of the valves 203, 205, 207, 208, 209, and 243 is adjusted by the capacity of the gas cylinder 211 and the diameter of the orifice 216.

Instead of the configuration of the instrumentation gas shut-off valve 213 by a pneumatic valve, electricity can be used as a driving source and the valve may be configured as a normal-open type electromagnetic valve opened when there is no supply of electricity. With this configuration, the instrumentation gas shut-off valve 213 is also opened by loss of the driving source at the emergency stop of the fluorine gas generating apparatus 100 caused by outage, each of the valves 203, 205, 207, 208, 209, and 243 is opened.

Subsequently, the emergency stop facility in the fluorine gas supply system 2 and the byproduct gas treatment system 3 will be described by referring to FIG. 1.

The emergency stop facility includes an abatement passage 221 provided in parallel with the first main passage 15.

The upstream side of the inlet valve 64 in the first main passage 15, that is, the first gas chamber 11*a* of the electrolytic cell 1 and the abatement passage 221 are connected to each other through a first discharge passage 222. The inlet valve 64 and the outlet valve 66 in the first main passage 15, that is, the inner tube 61 of the refining device 16 and the abatement passage 221 are connected to each other through a second discharge passage 223. Moreover, the outlet valve 66 in the first main passage 15 and the shut-off valve 22 are connected by a bypass passage 225 which bypasses the first pump 17, and the bypass passage 225 and the abatement passage 221 are connected to each other by a third discharge passage 224.

An abatement unit 226 is provided in the abatement passage 221, and the fluorine gas discharged in each of the discharge passages 222, 223, and 224 is rendered harmless in the abatement unit 226 and emitted.

The discharge passages 222, 223, and 224 include shut-off valves 227, 228, and 229 which switch between discharge and shut-off of the fluorine gas from the first main passage 15 to the abatement passage 221, respectively. Moreover, on the downstream of the shut-off valves 227, 228 and 229, check valves 230, 231, and 232 which allow only the flow of the fluorine gas from the first main passage 15 to the abatement passage 221 are provided.

The shut-off valves 227, 228, and 229 are pneumatic valves driven by the instrumentation gas supplied from the instrumentation gas supply facility 210 for emergency stop and normal-close type valves closed in the usual state in which the instrumentation gas is not supplied. Therefore, the shut-off valves 227, 228, and 229 are opened upon receipt of the supply of the instrumentation gas which is the driving source at emergency stop of the fluorine gas generating apparatus 100.

Moreover, a bypass passage 240 which bypasses the shut-off valve 35 is connected to the second main passage 30. A bypass shut-off valve 241 is provided in the bypass passage 240.

The bypass shut-off valve 241 is a pneumatic valve driven by the instrumentation gas supplied from the instrumentation gas supply facility 210 for emergency stop and a normal-close type valve closed in the usual state in which there is no supply of the instrumentation gas. Therefore, the bypass shut-off valve 241 is opened upon receipt of supply of the instrumentation gas which is the driving source at emergency stop of the fluorine gas generating apparatus 100.

Subsequently, an operation of the emergency stop facility will be described.

At the emergency stop of the fluorine gas generating apparatus 100 caused by outage, a failure of the compressor or the like, the supply of the compressed air to each of the shut-off valves 43, 47, and 33 from the compressor is stopped, and thus, the supply of the nitrogen gas to the liquid level meter 13, the hydrogen fluoride supply passage 41, and the second main passage 30 from the nitrogen gas supply source 45 is stopped. Moreover, the supply of the compressed air to the inlet value 64, the outlet vale 66, the shut-off valve 22, the shut-off valve 23 of the fluorine gas supply system 2, and the shut-off valve 35 of the byproduct gas treatment system 3 from the compressor is also stopped, and thus, each of these valves is closed. Therefore, at emergency stop of the fluorine gas generating apparatus 100, the above-described situation might occur at each spot of the fluorine gas generating apparatus 100.

However, the instrumentation gas shut-off valve 213 is opened by loss of the compressed air which is the driving source, and the cooling medium shut-off valve 203, the alternative gas shut-off source valve 205, the alternative purge gas shut-off valve 207, the alternative diluent gas shut-off valve 208, and the alternative entrained gas shut-off valve 209 are opened upon receipt of the supply of the instrumentation gas of the gas cylinder 211.

The liquid nitrogen in the jacket tube 71 is discharged into the nitrogen buffer tank 202 by means of opening of the cooling medium shut-off valve 203. The inside of the nitrogen buffer tank 202 upon receipt of discharge of the liquid nitrogen is composed of two layers, that is, the liquid nitrogen and the nitrogen gas, and the nitrogen gas is supplied to the liquid level meter 13, the second main passage 30, and the hydrogen fluoride supply passage 41 through the alternative purge gas supply passage 204*a*, the alternative diluent gas supply passage 204*b*, and the alternative entrained gas supply passage 204*c*. Then, in the liquid level meter 13, since the emergency supply valve 243 is also opened upon receipt of the supply of the instrumentation gas of the gas cylinder 211, the purge gas is supplied into the molten salt while bypassing the usual-time supply valve 242 closed by stop of the supply of the compressed air from the compressor. As described above, even if the supply of the nitrogen gas from the nitrogen gas supply source 45 is shut-off, the nitrogen gas is supplied as an alternative gas from the nitrogen buffer tank 202, and thus, the same state as that before the emergency stop of the fluorine gas generating apparatus 100 can be kept. Therefore, blocking of the hydrogen fluoride supply passage 41 due to a failure of the liquid level meter 13, a rise in the hydrogen gas concentration in the second main passage 30, and backflow of the molten salt can be prevented.

When the instrumentation gas shut-off valve 213 is opened, the shut-off valves 227, 228, and 229 of the fluorine gas supply system 2 are also opened upon receipt of supply of the instrumentation gas of the gas cylinder 211. As a result, the first gas chamber 11*a* of the electrolytic cell 1, the inner tube 61, and the first pump 17 communicate with the abatement passage 221. Moreover, by opening the instrumentation gas shut-off valve 213, the bypass shut-off valve 241 of the byproduct gas treatment system 3 is also opened upon receipt of the supply of the instrumentation gas of the gas cylinder 211. As a result, the second gas chamber 12*a* of the electrolytic cell 1 communicates with the abatement unit 34, and the same state as that before the emergency stop of the fluorine gas generating apparatus 100 is kept. As described above, even if each valve of the fluorine gas supply system 2 and the byproduct gas treatment system 3 is closed at the emergency stop of the fluorine gas generating apparatus 100, the electrolytic cell 1, the inner tube 61, and the first pump 17 are prevented from being sealed, and the rise of the internal pressure is prevented.

Since the instrumentation gas supplied from the gas cylinder 211 is emitted to the atmosphere through the emission passage 215, each valve having been opened upon receipt of the supply of the instrumentation gas is closed after predetermined time has elapsed. Here, since the usual-time supply valve 242 and the emergency supply valve 243 are both closed in the liquid level meter 13, hydrogen fluoride vapor in the electrolytic cell 1 is prevented from flowing into the liquid level meter 13 even after the supply of the purge gas is stopped by closing the alternative purge gas shut-off valve 207. Moreover, since the emergency supply valve 243 is closed after the inside of the insertion pipe 13*a* is sufficiently replaced by the purge gas, the liquid level meter 13 can detect the liquid level of the molten salt quickly when the fluorine gas generating apparatus 100 is restarted.

The capacity of the gas cylinder 211 and the diameter of the orifice 216 regulating the open time of each valve are determined from the viewpoint of the required supply flow rate of the alternative gas to the liquid level meter 13, the hydrogen fluoride supply passage 41, and the second main passage 30 and prevention of pressure rise of the electrolytic cell 1, the inner tube 61, and the first pump 17.

As described above, even after the fluorine gas generating apparatus 100 is emergently stopped, blocking of the hydrogen fluoride supply passage 41, a failure of the liquid level meter 13, the pressure rise of the electrolytic cell 1 and the first main passage 15, the rise of the hydrogen gas concentration in the second main passage 30 and the like are prevented by operation of the emergency stop facility, and the fluorine gas generating apparatus 100 can be safely stopped. Therefore, when outage, a failure of the compressor or the like is recovered, the fluorine gas generating apparatus 100 can be restarted quickly even without a special operation such as gas replacement of the hydrogen fluoride supply passage 41 or the like.

According to the above embodiment, the working effect described below is exerted.

At the emergency stop of the fluorine gas generating apparatus 100, the instrumentation gas shut-off valve 213 is opened, the liquid nitrogen in the jacket tube 71 is supplied as the alternative gas to the liquid level meter 13, the hydrogen fluoride supply passage 41, and the second main passage 30 with that, and the pressure rise in the electrolytic cell 1 and the first main passage 15 is prevented. Therefore, at the emergency of the fluorine gas generating apparatus 100, the fluorine gas generating apparatus 100 can be safely stopped, and when outage, a failure of the compressor or the like is recovered, the fluorine gas generating apparatus 100 can be quickly restarted.

Another form of the above-described embodiment will be described.

(1) In the above-described embodiment, the compressed air filled in the gas cylinder 211 is used as the instrumentation gas. Instead, the nitrogen gas in the nitrogen buffer tank 202 may be used as the instrumentation gas. That is, the nitrogen gas in the nitrogen buffer tank 202 may be used as an alternative gas of the nitrogen gas of the nitrogen gas supply source 45 and also as the instrumentation gas of the instrumentation gas supply facility 210 for emergency stop. However, from the viewpoint of ensuring the supply amount of the nitrogen gas and a required driving pressure for each valve opened upon receipt of the instrumentation gas, the supply of the instrumentation gas from the gas cylinder 211 is preferable.

(2) In the above-described embodiment, the liquid nitrogen discharged from the cooling device 70 of the refining device 16 is recovered by the nitrogen buffer tank 202 and then, the nitrogen gas in the nitrogen buffer tank 202 is used as an alternative gas. Instead, the liquid nitrogen discharged from the cooling device 70 may be directly used as an alternative gas. In that case, an evaporator using heat exchange needs to be provided on the downstream side of the liquid nitrogen discharge passage 90 for gasification of the liquid nitrogen.

(3) In the above-described embodiment, the liquid nitrogen is used as a cooling medium used in the refining device 16. However, the cooling medium is not limited to the liquid nitrogen and liquid argon or the like may be used.

(4) In the above-described embodiment, as a factor of the emergency stop of the fluorine gas generating apparatus 100, outage and a failure of the compressor are cited. However, the factors of the emergency stop of the fluorine gas generating apparatus 100 are not limited to them but also include a failure of a controller of the fluorine gas generating apparatus 100 and manual and automatic emergency stop caused by a failure of the electrolytic cell 1 or each valve.

(5) In the above-described embodiment, the nitrogen buffer tank 202 is arranged below the jacket tube 71. However, the nitrogen buffer tank 202 may be arranged at the same level as the jacket tube 71 or above the jacket tube 71. In that case, in order to discharge the liquid nitrogen in the jacket tube 71 into the nitrogen buffer tank 202, a pump driven by the instrumentation gas of the gas cylinder 211 needs to be provided in the liquid nitrogen discharge passage 90. Moreover, instead of providing the pump, the liquid nitrogen in the jacket tube 71 may be discharged into the nitrogen buffer tank 202 by pressurizing a gas phase unit in the jacket tube 71.

(6) In the above-described embodiment, as a shut-off valve of the alternative gas supply facility 201, the alternative purge gas shut-off valve 207, the alternative diluent gas shut-off valve 208, and the alternative entrained gas shut-off valve 209 are also provided in the configuration in addition of the alternative gas shut-off source valve 205. However, instead of them, only the alternative gas shut-off source valve 205 may be provided or only the alternative purge gas shut-off valve 207, the alternative diluent gas shut-off valve 208, and the alternative entrained gas shut-off valve 209 may be provided in the configuration without providing the alternative gas shut-off source valve 205.

The embodiments of the present invention have been described, but the embodiments only illustrate a part of application examples of the present invention and are not intended to limit the technical scope of the present invention to the specific configurations of the embodiments.

This application claims priority on the basis of Japanese Patent Application No. 2010-11010 filed with Japan Patent Office on Jan. 21, 2010 and the whole contents of this application are incorporated in this description by reference.

What is claimed is:

1. A fluorine gas generating apparatus which generates a fluorine gas by electrolyzing hydrogen fluoride in molten salt, comprising:

an electrolytic cell divided above a liquid level of the molten salt into a first gas chamber into which a product gas mainly containing a fluorine gas generated at an anode immersed in the molten salt is led and a second gas chamber into which a byproduct gas mainly containing a hydrogen gas generated at a cathode immersed in the molten salt is led;

a refining device configured to refine the fluorine gas by coagulating with a cooling medium and trapping a hydrogen fluoride gas evaporated from the molten salt in the electrolytic cell and mixed in the product gas generated from the anode;

a hydrogen fluoride supply passage configured to replenish hydrogen fluoride of a hydrogen fluoride supply source in the electrolytic cell;

an entrained gas supply source configured to supply an entrained gas for leading the hydrogen fluoride of the hydrogen fluoride supply source to the electrolytic cell to the hydrogen fluoride supply passage;

an entrained gas shut-off valve configured to switch between supply and shut-off of the entrained gas of the entrained gas supply source; and an emergency stop facility configured to operate at emergency stop of the fluorine gas generating apparatus, wherein the emergency stop facility includes:

an alternative gas supply facility configured to supply the cooling medium which was used for coagulation of the hydrogen fluoride gas in the refining device as an alternative gas instead of the entrained gas shut-off by closure of the entrained gas shut-off valve with loss of a driving source caused by the emergency stop of the fluorine gas generating apparatus;

an alternative gas shut-off valve configured to switch between supply and shut-off of the alternative gas of the alternative gas supply facility to the hydrogen fluoride supply passage; and an instrumentation gas supply facility for emergency stop having an instrumentation gas shut-off valve configured to supply an instrumentation gas by opening with loss of the driving source caused by the emergency stop of the fluorine gas generating apparatus, wherein the fluorine gas generating apparatus is configured such that at the emergency stop, the alternative gas shut-off valve is opened upon receipt of the supply of the instrumentation gas of the instrumentation gas supply facility for emergency stop, and the alternative gas of the alternative gas supply facility is supplied to the hydrogen fluoride supply passage.

2. The fluorine gas generating apparatus according to claim 1, wherein the refining device includes:

a gas inflow unit configured to receive the product gas containing the hydrogen fluoride gas flows; and a cooling device configured to cool the gas inflow unit at a temperature not lower than a boiling point of fluorine and not higher than a melting point of hydrogen fluoride by using the cooling medium so that the hydrogen fluoride gas mixed in the product gas is coagulated, while the fluorine gas passes through the gas inflow unit;

the alternative gas supply facility includes;

a buffer tank configured to recover and store the cooling medium discharged from the cooling device and supply the cooling medium as an alternative gas; and a cooling medium shut-off valve configured to switch between discharge and shut-off of the cooling medium of the cooing device to the buffer tank; and the fluorine gas generating apparatus is configured such that at the emergency stop, the cooling medium shut-off valve is opened upon receipt of the supply of the instrumentation gas of the instrumentation gas supply facility for emergency stop and the cooling medium of the cooling device is discharged to the buffer tank.

3. The fluorine gas generating apparatus according to claim 1, wherein the instrumentation gas supply facility for emergency stop includes:

an instrumentation gas container filled with an instrumentation gas;

an emission passage which is provided downstream of the instrumentation gas shut-off valve and configured to emit the instrumentation gas to the atmosphere; and a flow rate limitation unit which is provided in the emission passage and is configured to limit an emission flow rate of the instrumentation gas.

4. The fluorine gas generating apparatus according to claim 2, wherein the cooling medium stored in the buffer tank is configured to be used as an alternative gas of the entrained gas and used as the instrumentation gas of the instrumentation gas supply facility for emergency stop.

5. The fluorine gas generating apparatus according to claim 1, further comprising:

a first main passage connected to the first gas chamber and configured to supply the product gas to an external device, wherein the emergency stop facility includes:

an abatement passage provided in parallel with the first main passage;

a discharge passage which connects the first main passage and the abatement passage; and a shut-off valve which is provided in the discharge passage and is configured to switch between discharge and shut-off of the product gas from the first main passage to the abatement passage, wherein the fluorine gas generating apparatus is configured such that at the emergency stop, the shut-off valve is opened upon receipt of the supply of the instrumentation gas of the instrumentation gas supply facility for emergency stop and the product gas of the first main passage is discharged to the abatement passage.

* * * * *